US008970197B2

(12) United States Patent
Chen

(10) Patent No.: US 8,970,197 B2
(45) Date of Patent: Mar. 3, 2015

(54) VOLTAGE REGULATING CIRCUIT CONFIGURED TO HAVE OUTPUT VOLTAGE THEREOF MODULATED DIGITALLY

(75) Inventor: Shi-Wen Chen, Kaohsiung (TW)

(73) Assignee: United Microelectronics Corporation, Hsinchu (TW)

( * ) Notice: Subject to any disclaimer, the term of this patent is extended or adjusted under 35 U.S.C. 154(b) by 207 days.

(21) Appl. No.: 13/565,799

(22) Filed: Aug. 3, 2012

(65) Prior Publication Data

US 2014/0035550 A1 Feb. 6, 2014

(51) Int. Cl.
*G05F 1/00* (2006.01)

(52) U.S. Cl.
USPC ..... 323/283; 323/280

(58) Field of Classification Search
USPC ..... 323/271, 282, 283, 311, 280
See application file for complete search history.

(56) References Cited

U.S. PATENT DOCUMENTS 3,663,828 A 5/1972 Low
3,818,402 A 6/1974 Golaski et al.
4,163,944 A 8/1979 Chambers
4,245,355 A 1/1981 Pascoe
4,409,608 A 10/1983 Yoder
4,816,784 A 3/1989 Rabjohn
4,901,076 A * 2/1990 Askin et al. ..... 341/100
5,159,205 A 10/1992 Gorecki
5,208,725 A 5/1993 Akcasu
5,212,653 A 5/1993 Tanaka
5,406,447 A 4/1995 Miyazaki
5,446,309 A 8/1995 Adachi
5,583,359 A 12/1996 Ng
5,637,900 A 6/1997 Ker
5,760,456 A 6/1998 Grzegorek
5,808,330 A 9/1998 Rostoker
5,923,225 A 7/1999 De Los Santos
5,959,820 A 9/1999 Ker
6,008,102 A 12/1999 Alford
6,081,146 A 6/2000 Shiochi
6,172,378 B1 1/2001 Hull
6,194,739 B1 2/2001 Ivanov
6,212,127 B1 * 4/2001 Funaba et al. ..... 365/233.12
6,246,271 B1 6/2001 Takada
6,285,578 B1 9/2001 Huang
6,291,872 B1 9/2001 Wang
6,370,372 B1 4/2002 Molnar
6,407,412 B1 6/2002 Iniewski
6,427,226 B1 7/2002 Mallick
6,448,858 B1 9/2002 Helms
6,452,442 B1 9/2002 Laude
6,456,221 B2 9/2002 Low
6,461,914 B1 10/2002 Roberts
6,480,137 B2 11/2002 Kulkarni
6,483,188 B1 11/2002 Yue
6,486,765 B1 11/2002 Katayanagi (Continued)

*Primary Examiner* — Emily P Pham
(74) *Attorney, Agent, or Firm* — Ding Yu Tan

(57) ABSTRACT

A voltage regulator circuit includes a plurality of transistors and a control circuit. Each transistor has two source/drain terminal and a gate terminal. One source/drain terminal of each transistor is electrically coupled to a source voltage, and the other source/drain terminals of the transistors are electrically coupled to each other and corporately referred to as an output terminal of the voltage regulator circuit. The control circuit is electrically coupled to the gate terminals of the transistors and configured to determine the number of the transistors to be turned on according to the difference between the voltage at the output terminal and a predetermined reference voltage.

18 Claims, 4 Drawing Sheets

(56) References Cited

U.S. PATENT DOCUMENTS

| | | | | |
|---|---|---|---|---|
| 6,509,805 | B2 | 1/2003 | Ochiai | |
| 6,518,165 | B1 | 2/2003 | Yoon et al. | |
| 6,521,939 | B1 | 2/2003 | Yeo | |
| 6,545,547 | B2 | 4/2003 | Fridi | |
| 6,560,306 | B1 | 5/2003 | Duffy | |
| 6,588,002 | B1 | 7/2003 | Lampaert | |
| 6,593,838 | B2 | 7/2003 | Yue | |
| 6,603,360 | B2 | 8/2003 | Kim | |
| 6,608,363 | B1 | 8/2003 | Fazelpour | |
| 6,611,223 | B2 | 8/2003 | Low | |
| 6,625,077 | B2 | 9/2003 | Chen | |
| 6,630,897 | B2 | 10/2003 | Low | |
| 6,639,298 | B2 | 10/2003 | Chaudhry | |
| 6,653,868 | B2 | 11/2003 | Oodaira | |
| 6,668,358 | B2 | 12/2003 | Friend | |
| 6,700,771 | B2 | 3/2004 | Bhattacharyya | |
| 6,720,608 | B2 | 4/2004 | Lee | |
| 6,724,677 | B1 | 4/2004 | Su | |
| 6,756,656 | B2 | 6/2004 | Lowther | |
| 6,795,001 | B2 | 9/2004 | Roza | |
| 6,796,017 | B2 | 9/2004 | Harding | |
| 6,798,011 | B2 | 9/2004 | Adan | |
| 6,810,242 | B2 | 10/2004 | Molnar | |
| 6,822,282 | B2 | 11/2004 | Randazzo | |
| 6,822,312 | B2 | 11/2004 | Sowlati | |
| 6,833,756 | B2 | 12/2004 | Ranganathan | |
| 6,839,252 | B2 * | 1/2005 | Tai et al. | 363/65 |
| 6,841,847 | B2 | 1/2005 | Sia | |
| 6,847,572 | B2 | 1/2005 | Lee | |
| 6,853,272 | B1 | 2/2005 | Hughes | |
| 6,876,056 | B2 | 4/2005 | Tilmans | |
| 6,885,534 | B2 | 4/2005 | Ker | |
| 6,901,126 | B1 | 5/2005 | Gu | |
| 6,905,889 | B2 | 6/2005 | Lowther | |
| 6,909,149 | B2 | 6/2005 | Russ | |
| 6,927,664 | B2 | 8/2005 | Nakatani | |
| 6,958,522 | B2 | 10/2005 | Clevenger | |
| 7,009,252 | B2 | 3/2006 | Lin | |
| 7,027,276 | B2 | 4/2006 | Chen | |
| 7,205,612 | B2 | 4/2007 | Cai | |
| 7,224,145 | B2 * | 5/2007 | Pierret et al. | 322/25 |
| 7,262,069 | B2 | 8/2007 | Chung | |
| 7,312,598 | B1 | 12/2007 | Huang | |
| 7,320,097 | B2 * | 1/2008 | Ishiyama | 714/726 |
| 7,365,627 | B2 | 4/2008 | Yen | |
| 7,368,761 | B1 | 5/2008 | Lai | |
| 7,405,642 | B1 | 7/2008 | Hsu | |
| 7,501,693 | B2 | 3/2009 | Chu | |
| 7,672,100 | B2 | 3/2010 | Van Camp | |
| 7,898,233 | B2 * | 3/2011 | Sato et al. | 323/283 |
| 8,324,875 | B2 * | 12/2012 | Miki et al. | 323/272 |
| 2002/0019123 | A1 | 2/2002 | Ma | |
| 2002/0036545 | A1 | 3/2002 | Fridi | |
| 2002/0188920 | A1 | 12/2002 | Lampaert | |
| 2003/0076636 | A1 | 4/2003 | Ker | |
| 2003/0127691 | A1 | 7/2003 | Yue | |
| 2003/0183403 | A1 | 10/2003 | Kluge | |
| 2005/0068112 | A1 | 3/2005 | Glenn | |
| 2005/0068113 | A1 | 3/2005 | Glenn | |
| 2005/0087787 | A1 | 4/2005 | Ando | |
| 2006/0006431 | A1 | 1/2006 | Jean | |
| 2006/0108694 | A1 | 5/2006 | Hung | |
| 2006/0267102 | A1 | 11/2006 | Cheng | |
| 2007/0102745 | A1 | 5/2007 | Hsu | |
| 2007/0210416 | A1 | 9/2007 | Hsu | |
| 2007/0234554 | A1 | 10/2007 | Hung | |
| 2007/0246801 | A1 | 10/2007 | Hung | |
| 2007/0249294 | A1 | 10/2007 | Wu | |
| 2007/0296055 | A1 | 12/2007 | Yen | |
| 2008/0094166 | A1 | 4/2008 | Hsu | |
| 2008/0144862 | A1 | 6/2008 | Xu | |
| 2008/0185679 | A1 | 8/2008 | Hsu | |
| 2008/0189662 | A1 | 8/2008 | Nandy | |
| 2008/0200132 | A1 | 8/2008 | Hsu | |
| 2008/0299738 | A1 | 12/2008 | Hsu | |
| 2008/0303623 | A1 | 12/2008 | Hsu | |
| 2009/0029324 | A1 | 1/2009 | Clark | |
| 2009/0051335 | A1 * | 2/2009 | Huang | 323/268 |
| 2009/0201625 | A1 | 8/2009 | Liao | |
| 2010/0279484 | A1 | 11/2010 | Wang | |
| 2012/0062192 | A1 * | 3/2012 | Okuma | 323/272 |

* cited by examiner

VOLTAGE REGULATING CIRCUIT CONFIGURED TO HAVE OUTPUT VOLTAGE THEREOF MODULATED DIGITALLY

FIELD OF THE INVENTION

The present invention relates to a voltage regulator circuit field, and more particularly to a voltage regulator circuit configured to have its output voltage modulated in a digital manner.

BACKGROUND OF THE INVENTION

Typically, the conventional voltage regulator circuit includes an operational amplifier (OP Amp) and a power metal-oxide semiconductor field-effect transistor (MOSFET). Specifically, the power MOSFET is configured to have its one source/drain terminal providing an output voltage; and the operational amplifier is configured to control the conduction degree of the power MOSFET according to the value of the output voltage.

However, due to requiring operating the operational amplifier at saturation, the conventional voltage regulator circuit, cannot be operated at low voltages.

SUMMARY OF THE INVENTION

Therefore, one object of the present invention is to provide a voltage regulator circuit configured to have its output voltage modulated in a digital manner, and thereby the voltage regulator circuit is capable of being operated at low voltages.

An embodiment of the present invention provides a voltage regulator circuit, which includes a plurality of first transistors and a control circuit. Each first transistor has two source/drain terminals and a gate terminal. One source/drain terminal of each transistor is electrically coupled to a source voltage, and the other source/drain terminals of the transistors are electrically coupled to each other and corporately referred to as an output terminal of the voltage regulator circuit. The control circuit is electrically coupled to the gate terminals of the transistors and configured to determine the number of the transistors to be turned on according to the difference between the voltage at the output terminal and a predetermined reference voltage.

In summary, the voltage regulator circuit according to the present invention includes a plurality of transistors and a control circuit. Each of the transistors functions as a pull-up circuit for pulling up the level of voltage outputted from the voltage regulator circuit. The control circuit is configured to determine the number of the aforementioned transistors to be turned on according to the difference between the output voltage of the voltage regulator circuit and a predetermined reference voltage. In other words, the number of the transistors to be turned on in the voltage regulator circuit dynamically varies with the difference value between the output voltage of the voltage regulator circuit and the predetermined reference voltage. In addition, the voltage regulator circuit according to the present invention can be operated at a relatively low voltage due to being implemented in a digital manner.

BRIEF DESCRIPTION OF THE DRAWINGS

The embodiments of the present invention will become more readily apparent to those ordinarily skilled in the art after reviewing the following detailed description and accompanying drawings, in which.

DETAILED DESCRIPTION OF PREFERRED EMBODIMENTS

The embodiments of the present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
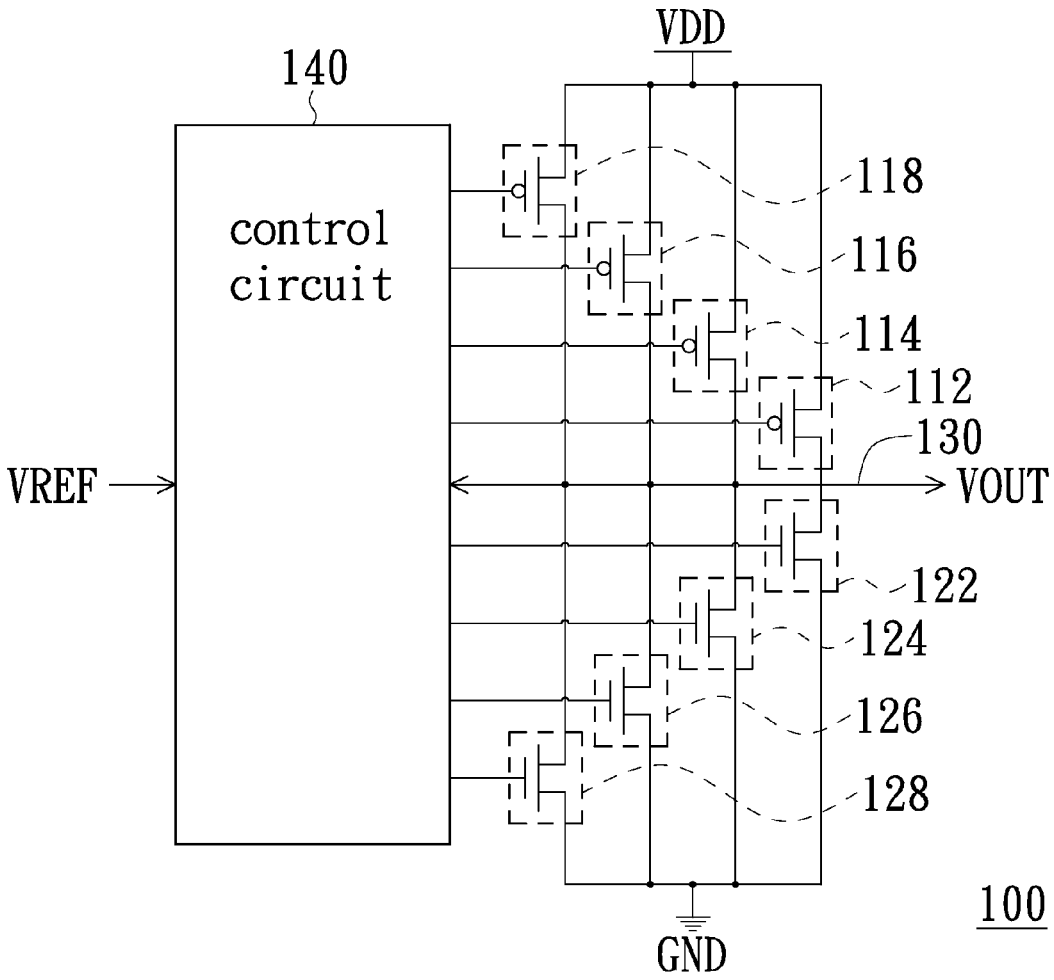
FIG. 1 is a schematic view of a voltage regulator circuit in accordance with an embodiment of the present invention.

FIG. 1 is a schematic view of a voltage regulator circuit in accordance with an embodiment of the present invention. As shown, the voltage regulator circuit 100 in this embodiment includes a control circuit 140 and a plurality of (for example, eight) transistors 112, 114, 116, 118, 122, 124, 126 and 128; wherein each of the transistors 112, 114, 116, 118, 122, 124, 126 and 128 has two source/drain terminals and a gate terminal. In this embodiment, the transistors 112, 114, 116 and 118 are P-type metal-oxide semiconductor field-effect transistors (MOSFET), and the transistors 122, 124, 126 and 128 are N-type metal-oxide semiconductor field-effect transistors.

Each of the transistors 112, 114, 116 and 118 is configured to have its one source/drain terminal electrically coupled to a source voltage VDD; and its the other source/drain terminal electrically coupled to an output terminal 130 of the voltage regulator circuit 100. In addition, each of the transistors 122, 124, 126 and 128 is configured to have its one source/drain terminal electrically coupled to the output terminal 130; and its other source/drain terminal electrically coupled to a reference voltage (for example, is electrically coupled to ground GND). According to the above circuit configurations, it is understood that each of the transistors 112, 114, 116 and 118 functions as a pull-up circuit, which is used to pull up the voltage level at the output terminal 130 of the voltage regulator circuit 100; and each of the transistors 122, 124, 126 and 128 functions as a pull-down circuit, which is used to pull down the voltage level at the output terminal 130 of the voltage regulator circuit 100.

The control circuit 140, electrically coupled to the gate terminals of the transistors 112, 114, 116, 118, 122, 124, 126 and 128, is configured to determine, based on the difference between the voltage VOUT at the output terminal 130 and a predetermined reference voltage VREF, the number of the transistors 112, 114, 116, 118, 122, 124, 126 and 128 to be turned on or turned off. For example, the control circuit 140 is configured to, if determining that the voltage VOUT drops and has a predetermined difference smaller than the predetermined reference voltage VREF, turn on at least one of the transistors 112, 114, 116 and 118 so as to pull up the voltage level of the voltage VOUT at the output terminal 130. In addition, it is to be noted that the number of the transistors 112, 114, 116 and 118 to be turned on increases with increasing difference between the voltage VOUT at the output terminal 130 and the predetermined reference voltage VREF.

Alternatively, the control circuit 140 is configured to, if determining that the voltage VOUT increases and has a predetermined difference greater than the predetermined reference voltage VREF, turn on at least one of the transistors 122, 124, 126 and 128 so as to pull down the voltage level of the voltage VOUT at the output terminal 130. In addition, it is to be noted that the number of the transistors 122, 124, 126 and 128 to be turned on increases with increasing difference between the voltage VOUT at the output terminal 130 and the predetermined reference voltage VREF. Thus, through the aforementioned modulation, the voltage VOUT at the output terminal 130 is stabilized due to the voltage level thereof can only vary in a predetermined range.

Figure 2:
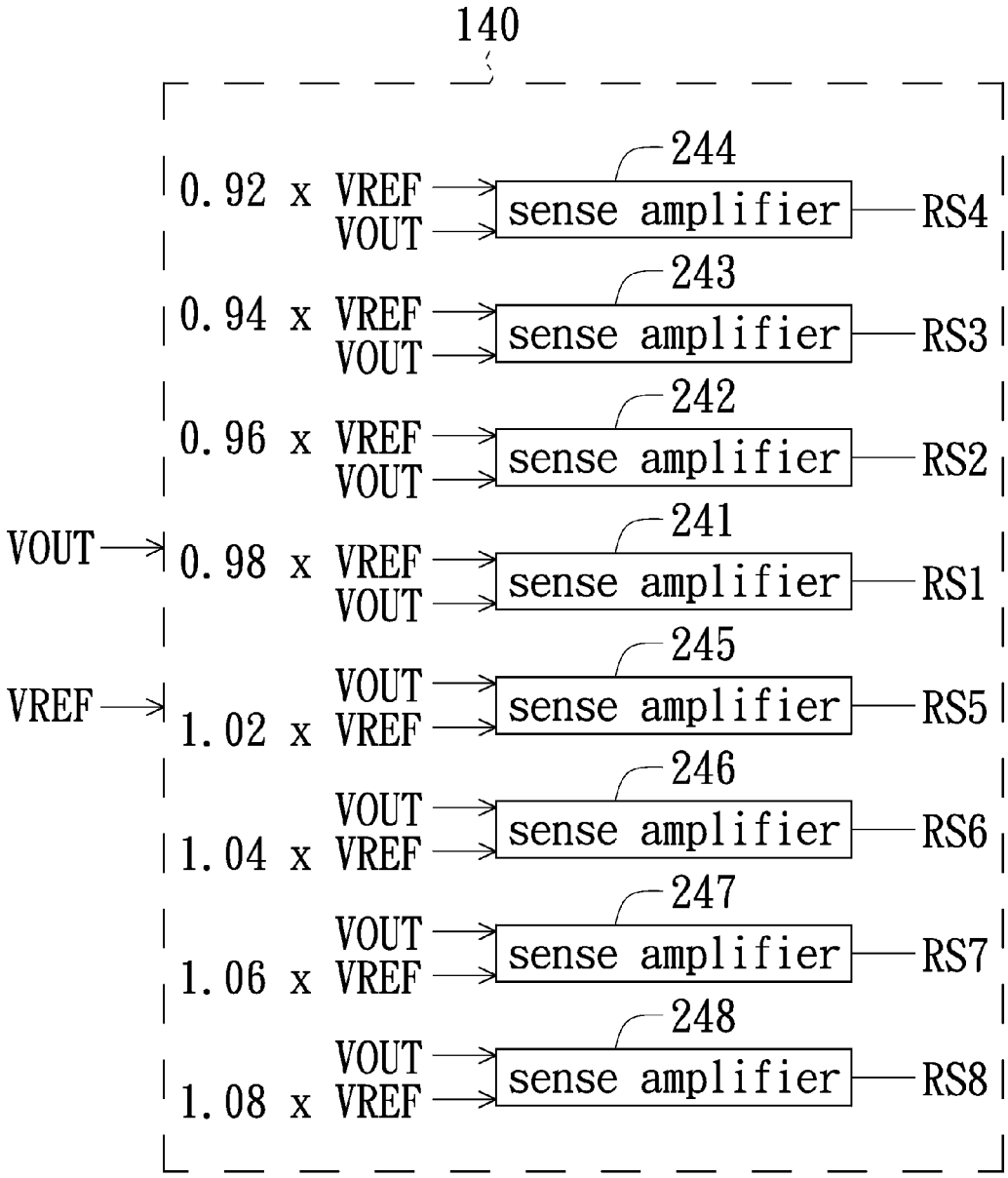
FIG. 2 is a schematic view of one circuit implementation of the control circuit depicted in FIG. 1.

The control circuit 140 can be implemented by several different circuit designs. FIG. 2 is a schematic view of one circuit implementation of the control circuit 140. As shown, the control circuit 140 includes a plurality of (for example, eight) sense amplifiers 241~248, which are commonly used in a memory, and each of them is configured to receive two voltages (i.e., a first and second voltages supplied into a first and second input terminals thereof, respectively), compare the two inputted voltages and accordingly output a comparison result. Specifically, the sense amplifiers 241~248 each output a logic-1 (or, logic-high) comparison result from an output terminal thereof if the first voltage is greater than the second voltage; alternatively, the sense amplifiers 241~248 each output a logic-0 (or, logic-low) comparison result if the second voltage is greater than the first voltage.

As illustrated in FIGS. 1, 2, the sense amplifiers 241~248, having their output terminals electrically coupled to the gate terminals of the respective transistors 112, 114, 116, 118, 122, 124, 126 and 128, are configured to output respective comparison results RS1, RS2, RS3, RS4, RS5, RS6, RS7 and RS8 by performing a comparison between the voltage VOUT at the output terminal 130 and the respective predetermined reference voltages of 0.98×VREF, 0.96×VREF, 0.94×VREF, 0.94×VREF, 1.02×VREF, 1.04×VREF, 1.06×VREF and 1.08×VREF. In this embodiment, the comparison results RS1, RS2, RS3, RS4, RS5, RS6, RS7 and RS8 are used to turn on or turn off the transistors 112, 114, 116, 118, 122, 124, 126 and 128, respectively; and the voltages of 0.92×VREF, 0.94×VREF, 0.96×VREF, 0.98×VREF, 1.02×VREF, 1.04×VREF, 1.06×VREF and 1.08×VREF are obtained through multiplying the predetermined reference voltage VREF by a plurality of different predetermined percentages.

Specifically, it is understood that the predetermined reference voltages of 0.92×VREF, 0.94×VREF, 0.96×VREF, and 0.98×VREF can be obtained by employing one or more voltage divider, and the predetermined reference voltages of 1.02×VREF, 1.04×VREF, 1.06×VREF, and 1.08×VREF can be obtained by employing one or more boost circuit or one or more charge pump; and the present invention is not limited thereto.

Please refer to FIG. 2 again. For example, in the case of the voltage VOUT at the output terminal 130 being smaller than a voltage of 0.98×VREF but greater than 0.96×VREF, the sense amplifier 241 is configured to output a logic-0 comparison result RS1 to turn on the P-type transistor 112 and thereby pulling up the voltage level of the voltage VOUT. Meanwhile, the sense amplifiers 242, 243 and 244 are configured to output logic-1 comparison results RS2, RS3 and RS4 to turn off the P-type transistors 114, 116 and 118, respectively; and the sense amplifiers 245, 246, 247 and 248 are configured to output logic-0 comparison results RS5, RS6, RS7 and RS8 to turn off the N-type transistors 122, 124, 126 and 128, respectively. In other words, when the voltage VOUT at the output terminal 130 drops and is smaller than a voltage of 0.98×VREF but greater than 0.96×VREF, only the transistor 112 is turned on and the rest of the transistors 114, 116, 118, 122, 124, 126 and 128 are turned off; and thus, the voltage level of the voltage VOUT is pulled up by the transistor 112 only and the transistors 114, 116, 118, 122, 124, 126 and 128 each are configured not to perform the pull-up or pull-down operations on the voltage VOUT.

In another case of the voltage VOUT at the output terminal 130 being smaller than a voltage of 0.96×VREF but greater than 0.94×VREF, the sense amplifiers 241, 242 are configured to output logic-0 comparison results RS1, RS2 to turn on the P-type transistors 112, 114, respectively, and thereby pulling up the voltage level of the voltage VOUT. Meanwhile, the sense amplifiers 243, 244 are configured to output logic-1 comparison results RS3, RS4 to turn off the P-type transistors 116, 118, respectively; and the sense amplifiers 245, 246, 247 and 248 are configured to output logic-0 comparison results RS5, RS6, RS7 and RS8 to turn off the N-type transistors 122, 124, 126 and 128, respectively. In other words, when the voltage VOUT at the output terminal 130 drops and is smaller than a voltage of 0.96×VREF but greater than 0.94×VREF, the transistors 112, 114 are turned on and the rest of the transistors 116, 118, 122, 124, 126 and 128 are turned off; and thus, the voltage level of the voltage VOUT is pulled up by the transistors 112, 114 and the transistors 116, 118, 122, 124, 126 and 128 are configured not to perform the pull-up or pull-down operations on the voltage VOUT. According to the aforementioned configurations, it is understood that the number of the transistors 112, 114, 116 and 118 to be turned on increases with increasing difference between the voltage VOUT at the output terminal 130 and the predetermined reference voltage VREF (i.e., with decreasing voltage VOUT at the output terminal 130 with relative to the predetermined reference voltage VREF); and accordingly the pull-up speed of the voltage VOUT at the output terminal 130 increases with increasing number of the transistors to be turned on in the transistors 112, 114, 116 and 118.

On the contrary, in the case of the voltage VOUT at the output terminal 130 being greater than a voltage of 1.02×VREF but smaller than 1.04×VREF, the sense amplifier 245 is configured to output a logic-1 comparison result RS5 to turn on the N-type transistor 122 and thereby pulling down the voltage level of the voltage VOUT. Meanwhile, the sense amplifiers 246, 247 and 248 are configured to output logic-0 comparison results RS6, RS7 and RS8 to turn off the N-type transistors 124, 126 and 128, respectively; and the sense amplifiers 241, 242, 243 and 244 are configured to output logic-1 comparison results RS1, RS2, RS3 and RS4 to turn off the P-type transistors 112, 114, 116 and 118, respectively. In other words, when the voltage VOUT at the output terminal 130 increases and is greater than a voltage of 1.02×VREF but smaller than 1.04×VREF, only the transistor 122 is turned on and the rest of transistors 112, 114, 116, 118, 124, 126 and 128 are turned off; and thus, the voltage level of the voltage VOUT is pulled down by the transistor 122 only and the transistors 112, 114, 116, 118, 124, 126 and 128 each are configured not to perform the pull-up or pull-down operations on the voltage VOUT.

In another case of the voltage VOUT at the output terminal 130 keeping increasing and being greater than a voltage of 1.04×VREF but smaller than 1.06×VREF, the sense amplifiers 245, 246 are configured to output logic-1 comparison results RS5, RS6 to turn on the N-type transistors 122, 124, respectively, and thereby pulling down the voltage level of the voltage VOUT. Meanwhile, the sense amplifiers 247, 248 are configured to output logic-0 comparison results RS7, RS8 to turn off the N-type transistors 126, 128, respectively; and the sense amplifiers 241, 242, 243 and 244 are configured to output logic-1 comparison results RS1, RS2, RS3 and RS4 to turn off the P-type transistors 112, 114, 116 and 118, respectively. In other words, when the voltage VOUT at the output terminal 130 increases and is greater than a voltage of 1.04× VREF but smaller than 1.06×VREF, the transistors 122, 124 are turned on and the rest of transistors 112, 114, 116, 118, 126 and 128 are turned off; and thus, the voltage level of the voltage VOUT is pulled down by the transistors 122, 124 and the transistors 112, 114, 116, 118, 126 and 128 are configured not to perform the pull-up or pull-down operations on the voltage VOUT. According to the aforementioned configurations, it is understood that the number of transistors 122, 124, 126 and 128 to be turned on increases with increasing difference between the voltage VOUT at the output terminal 130 and the predetermined reference voltage VREF (i.e., with increasing voltage VOUT at the output terminal 130 with relative to the predetermined reference voltage VREF); and accordingly the pull-down speed of the voltage VOUT at the output terminal 130 increases with increasing number of the transistors to be turned on in the transistors 122, 124, 126 and 128.

In summary, because the control circuit 140 dynamically switches on or off each of the transistors 112, 114, 116, 118, 122, 124, 126 and 128 based on a difference between the voltage VOUT at the output terminal 130 and the predetermined reference voltage VREF, the voltage VOUT at the output terminal 130 is stabilized due to the voltage level thereof can be only varied in a predetermined range.

Figure 3:
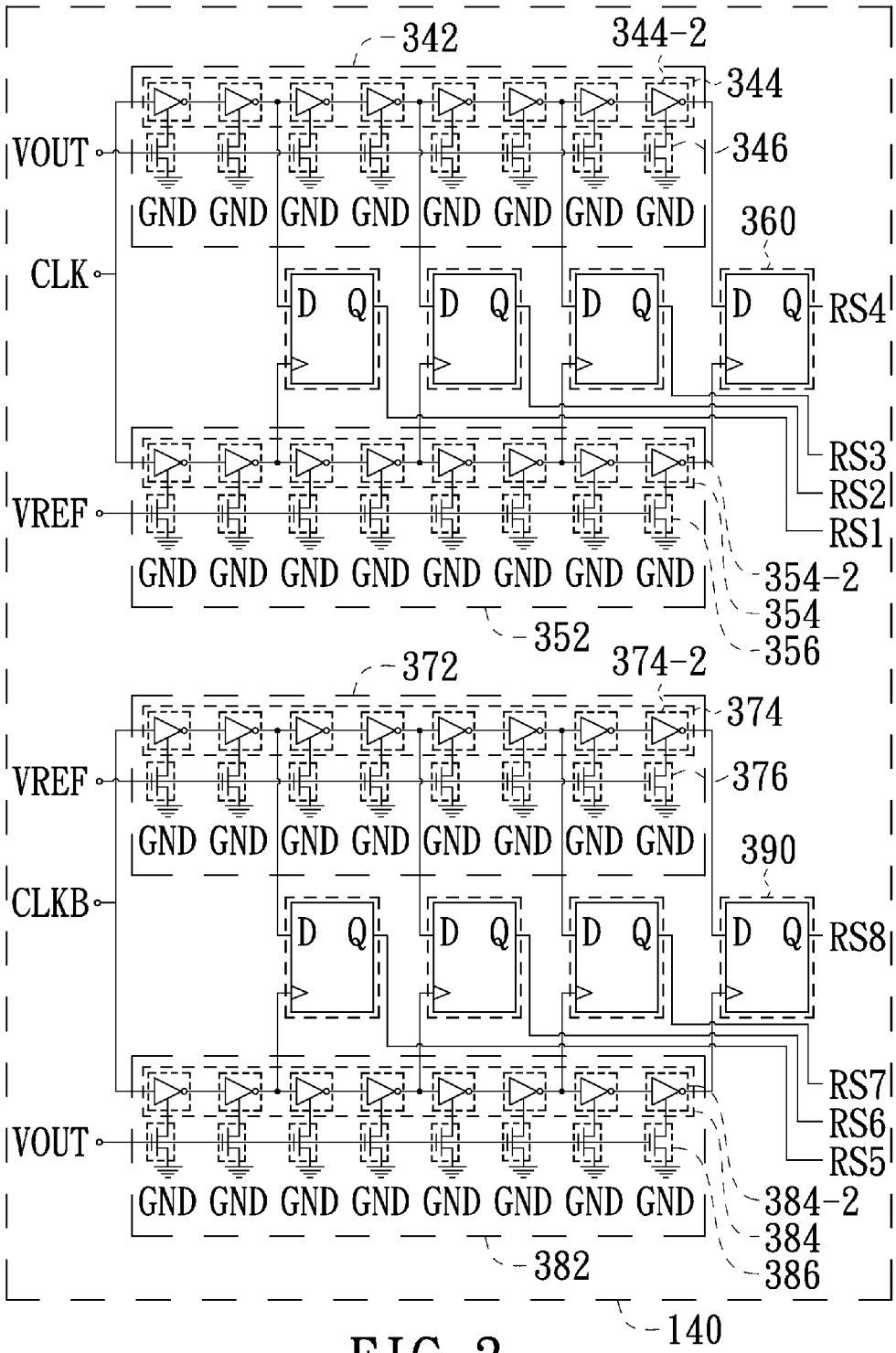
FIG. 3 is a schematic view of another circuit implementation of the control circuit depicted in FIG. 1.

FIG. 3 is a schematic view of another circuit implementation of the control circuit 140. As shown, the control circuit 140 includes a plurality of phase delay units 342, 352, 372 and 382, a plurality of (e.g., four) phase comparison units 360 and a plurality of (e.g., four) phase comparison units 390. The phase delay unit 342 includes a delay chain 344 and a plurality of (e.g., eight) delay control units 346. The delay chain 344, including a plurality of (e.g., eight) internal circuits 344-2 coupled in series, is configured to receive a clock signal CLK and delay the phase of the received clock signal CLK. The delay control unit 346 is, according to the value of the voltage VOUT at the output terminal 130 of the voltage regulator circuit 100, configured to control the time delay degree of the signal supplied to its associated internal circuit 344-2 in the delay chain 344; wherein the circuit connection structure of the delay control unit 346 and corresponding internal circuit 344-2 will be described in detail later.

Likewise, the phase delay unit 352 includes a delay chain 354 and a plurality of (e.g., eight) delay control units 356. The delay chain 354, including a plurality of (e.g., eight) internal circuits 354-2 coupled in series, is configured to receive a clock signal CLK and delay the phase of the received clock signal CLK. The delay control unit 356 is, according to the value of the reference voltage VREF, configured to control the time delay degree of the signal supplied to its associated internal circuit 354-2 in the delay chain 354. The phase comparison unit 360 is configured to have its two input terminals electrically coupled to an output of corresponding stage of the internal circuits 344-2 in the delay chain 344 and an output of corresponding stage of the internal circuits 354-2 in the delay chain 354, respectively, and generate a comparison result (i.e., one of the comparison results RS1, RS2, RS3 and RS4) by performing a comparison between the phases of the two output signals and thereby control the switch-on or switch-off of one transistor (i.e., one of the transistors 112, 114, 116 and 118). As mentioned above, the comparison results RS1, RS2, RS3 and RS4 are used to turn on or turn off the transistors 112, 114, 116 and 118, respectively.

Likewise, the phase delay unit 372 includes a delay chain 374 and a plurality of (e.g., eight) delay control units 376. The delay chain 374, including a plurality of (e.g., eight) internal circuits 374-2 coupled in series, is configured to receive an inversion signal CLKB of the clock signal CLK and delay the phase of the received inversion signal CLKB. The delay control unit 376 is, according to the value of the reference voltage VREF, configured to control the time delay degree of the signal supplied to its associated internal circuit 374-2 in the delay chain 374. Likewise, the phase delay unit 382 includes a delay chain 384 and a plurality of (e.g., eight) delay control units 386. The delay chain 384, including a plurality of (e.g., eight) internal circuits 384-2 coupled in series, is configured to receive the inversion signal CLKB and delay the phase of the received inversion signal CLKB. The delay control unit 386 is, according to the value of the voltage VOUT at the output terminal 130, configured to control the time delay degree of the signal supplied to its associated internal circuit 384-2 in the delay chain 384.

The phase comparison unit 390 is configured to have its two input terminals electrically coupled to an output of corresponding stage of internal circuits 374-2 in the delay chain 374 and an output of corresponding stage of the internal circuits 384-2 in the delay chain 384, respectively, and generate a comparison result (i.e., one of the comparison results RS5, RS6, RS7 and RS8) by performing a comparison between the phases of the two output signals and thereby control the switch-on or switch-off of one transistor (i.e., one of the transistors 122, 124, 126 and 128). As mentioned above, the comparison results RS5, RS6, RS7 and RS8 are used to turn on or turn off the transistors 122, 124, 126 and 128, respectively.

Additionally, in this embodiment the internal circuits 344-2, 354-2, 374-2 and 384-2 each can be implemented by an inverter; and the delay control units 346, 356, 376 and 386 each can be implemented by a transistor (e.g., an N-type MOS transistor). As depicted in FIG. 3, the transistors (i.e., delay control units) 346, 386 are configured to have their gate terminals receiving the voltage VOUT at the output terminal 130 of the voltage regulator circuit 100; and the transistors (i.e., delay control units) 356, 376 are configured to have their gate terminals receiving the predetermined reference voltage VREF. In addition, the inverters (i.e., internal circuits) 344-2, 354-2, 374-2 and 384-2 each are configured to be electrically coupled to the reference voltage (e.g., electrically coupled to ground GND) via the transistors (i.e., delay control units) 346, 356, 376 and 386, respectively.

Figure 4:
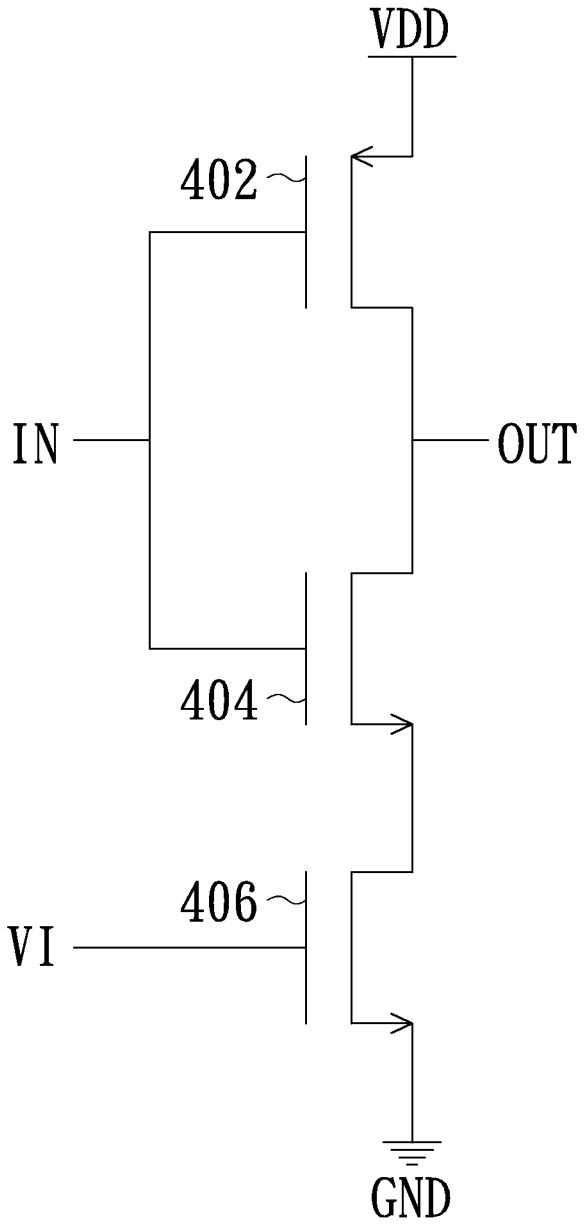
FIG. 4 is a schematic view illustrating one connection structure of an internal circuit and a corresponding delay control unit.

FIG. 4 is a schematic view illustrating one connection structure of one internal circuit and one corresponding delay control unit; wherein the internal circuit illustrated herein is implemented by an inverter, and the delay control unit is implemented by a transistor. As shown, the inverter is constituted by a P-type transistor 402 and an N-type transistor 404. The transistor 402 is configured to have its one source/drain terminal electrically coupled to the source voltage VDD; its the other source/drain terminal referred to as an output terminal of the inverter and providing an output signal OUT; and its gate terminal referred to as an input terminal of the inverter and receiving an input signal IN. The transistor 404 is configured to have its one source/drain terminal electrically coupled to the output terminal of the inverter; and its gate terminal electrically coupled to the input terminal of the inverter. The transistor (i.e., delay control unit) 406 is configured to have its one source/drain terminal electrically coupled to the other source/drain terminal of the transistor 404; its other source/drain terminal electrically coupled to a reference voltage (for example, is electrically coupled to ground GND); and its gate terminal receiving an input voltage VI. The input voltage VI is either the voltage VOUT at the output terminal 130 of the voltage regulator circuit 100 or the predetermined reference voltage VREF. According to the circuit structure illustrated in FIG. 4, it is understood that the charge/discharge speed of the voltage (i.e., output signal OUT) at the output terminal of the inverter increases with increasing input voltage VI.

Please refer back to FIG. 3. As shown, the phase comparison unit 360, 390 each can be implemented by a D-type flip-flop. The D-type flip-flop has a signal input terminal D, a clock input terminal Δ and a signal output terminal Q. Specifically, the D-type flip-flop (i.e., phase comparison unit) 360 is configured to have its signal input terminal D and clock input terminal Δ receiving the output signals of corresponding stage of the internal circuits 344-2, 354-2 in the delay chains 344, 354, respectively; and its signal output terminal Q outputting a comparison result (i.e., one of the comparison results RS1, RS2, RS3 and RS4). Likewise, the D-type flip-flop (i.e., phase comparison unit) 390 is configured to have its signal input terminal D and clock input terminal Δ receiving the output signals of corresponding stage of internal circuits 374-2, 384-2 in the delay chains 374, 384, respectively; and its signal output terminal Q outputting a comparison result (i.e., one of the comparison results RS5, RS6, RS7 and RS8). In addition, the D-type flip-flop outputs a logic-1 (or, logic-high) comparison result if the signal at the signal input terminal D has a phase lead with respect to the signal at the clock input terminal Δ; alternatively, the D-type flip-flop outputs a logic-0 (or, logic-low) comparison result if the signal at the signal input terminal D has a phase lag with respect to the signal at the clock input terminal Δ.

According to the circuit implementation of the control circuit 140 as illustrated in FIG. 3, it is understood that the values of voltage VOUT at the output terminal 130 of the voltage regulator circuit 100 and the predetermined reference voltage VREF each can be converted into a phase-delay degree by the delay chains 344, 354, 374 and 384 and the corresponding delay control units 346, 356, 376 and 386; wherein the phase delay degree decreases with increasing voltage value. Therefore, the phase comparison units 360, 390 each can, according to the phase relationship between the two inputted signals, generate a comparison result (i.e., one of the comparison results RS1, RS2, RS3, RS4, RS5, RS6, RS7 and RS8) to turn on or turn off its corresponding transistor (i.e., one of the transistors 112, 114, 116, 118, 122, 124, 126 and 128). In addition, according to the circuit implementation of the control circuit 140 as illustrated in FIG. 3, it is understood that the number of the transistors 112, 114, 116 and 118 to be turned on, as well as the pull-up speed of the voltage level of the voltage VOUT at the output terminal 130, increases with increasing difference between the voltage VOUT and the predetermined reference voltage VREF. Alternatively, the number of the transistors 122, 124, 126 and 128 to be turned on, as well as the pull-down speed of the voltage level of the voltage VOUT at the output terminal 130, increases with increasing difference between the voltage VOUT at the output terminal 130 and the predetermined reference voltage VREF.

In addition, it is to be noted that the voltage regulator circuit 100 according to the present invention is not limited to the element size (specifically, the aspect ratio) of the transistors arranged therein. In other words, the transistors 112, 114, 116 and 118 can have the same element size and the transistors 122, 124, 126 and 128 can have the same element size. Or, all the transistors 112, 114, 116, 118, 122, 124, 126 and 128 can have the same element size. Or, the transistors 112, 114, 116 and 118 can have different element sizes and the transistors 122, 124, 126 and 128 can have different element sizes. Or, all the transistors 112, 114, 116, 118, 122, 124, 126 and 128 can have different element sizes.

In addition, it is apparent to those ordinarily skilled in the art that the voltage regulator circuit 100 can be implemented by the transistors 112, 114, 116 and 118 only without the transistors 122, 124, 126 and 128; and accordingly, the control circuit 140 is configured to control the transistors 112, 114, 116 and 118 only. For example, in the case of having a circuit implementation as illustrated in FIG. 2, the control circuit 140 can employ the sense amplifiers 241, 242, 243 and 244 only; and in the case of having a circuit implementation as illustrated in FIG. 3, the control circuit 140 can employ the phase delay units 342, 352 and the associated phase comparison units 360 only. In addition, it is understood that the voltage regulator circuit 100 according to the present invention is not limited to the number of the transistors (i.e. transistors 112, 114, 116, 118, 122, 124, 126 and 128) arranged therein. In other words, the number of the transistors adopted in the voltage regulator circuit 100 can be adjusted according to an actual design requirement; and accordingly, the number of sense amplifiers (i.e. sense amplifiers 241~248) adopted in the control circuit 140 having a circuit implementation illustrated in FIG. 2 should be adjusted correspondingly, or the number of stages in the delay chains (i.e. the delay chains 344, 354, 374 and 384) and the number of phase comparison units (i.e., the phase comparison units 360, 390) adopted in the control circuit 140 having a circuit implementation illustrated in FIG. 3 should be adjusted correspondingly.

In summary, the voltage regulator circuit according to the present invention includes a plurality of transistors and a control circuit. Each of the transistors functions as a pull-up circuit for pulling up the level of voltage outputted from the voltage regulator circuit. The control circuit is configured to determine the number of the aforementioned transistors to be turned on according to the difference between the output voltage of the voltage regulator circuit and a predetermined reference voltage. In other words, the number of the transistors to be turned on in the voltage regulator circuit dynamically varies with the difference value between the output voltage of the voltage regulator circuit and the predetermined reference voltage. In addition, the voltage regulator circuit according to the present invention can be operated by a relatively low voltage due to being implemented in a digital manner.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A voltage regulating circuit, comprising:

a plurality of first transistors, each of said plurality of the first transistors having a first source/drain terminal, a second source/drain terminal and a first gate terminal, the first source/drain terminals of the plurality of first transistors being electrically coupled to a source voltage, the second source/drain terminals of the plurality of first transistors being electrically coupled to an output terminal of the voltage regulating circuit; and a control circuit electrically coupled to the first gate terminals of the plurality of first transistors and configured to determine a number of said plurality of the first transistors to be turned on according to a difference between a voltage at the output terminal and a first predetermined reference voltage;

wherein the control circuit comprises:

a plurality of first sense amplifiers, each of said plurality of the first sense amplifiers being electrically coupled to a corresponding first gate terminal and configured to compare the voltage at the output terminal with one of a plurality of second predetermined reference voltages, so as to generate a first comparison result and turn on or turn off a corresponding first transistor according to the first comparison result, wherein said plurality of the second predetermined reference voltages are smaller than the first predetermined reference voltage, and said plurality of the second predetermined reference voltages are obtained through multiplying the first predetermined reference voltage by a plurality of predetermined percentages, wherein each of said plurality of the predetermined percentages are different.

2. The voltage regulating circuit according to claim 1, wherein the plurality of first transistors have the same element size.

3. The voltage regulating circuit according to claim 1, wherein the plurality of first transistors have different element sizes.

4. The voltage regulating circuit according to claim 1, further comprising:

a plurality of second transistors, each of said plurality of the second transistors having a third source/drain, a fourth source/drain terminal and a second gate terminal, the third source/drain terminal being electrically coupled to the output terminal of the voltage regulator circuit, the fourth source/drain terminal being electrically coupled to a reference voltage, wherein the control circuit is further electrically coupled to the second gate terminals and configured to determine a number of said plurality of the second transistors to be turned on according to the difference between the voltage at the output terminal and the first predetermined reference voltage.

5. The voltage regulating circuit according to claim 4, wherein the control circuit comprises:

a plurality of second sense amplifiers, each second sense amplifier being electrically coupled to a corresponding second gate terminal and configured to compare the voltage at the output terminal with one of a plurality of third predetermined reference voltages, so as to generate a second comparison result and turn on or turn off a corresponding second transistor according to the second comparison result, wherein said plurality of the third predetermined reference voltages are greater than the first predetermined reference voltage, and the third predetermined reference voltages are obtained through multiplying the first predetermined reference voltage by a plurality of predetermined percentages, wherein each of said plurality of the predetermined percentages are different.

6. The voltage regulating circuit according to claim 4, wherein said plurality of the first and the second transistors have the same element size.

7. The voltage regulating circuit according to claim 4, wherein said plurality of the first and the second transistors have different element sizes.

8. A voltage regulating circuit, comprising:

a plurality of first transistors, each of said plurality of the first transistor having a first source/drain terminal, a second source/drain terminal and a first gate terminal, the first source/drain terminals of the plurality of first transistors being electrically coupled to a source voltage, the second source/drain terminals of the plurality of first transistors being electrically coupled to an output terminal of the voltage regulating circuit; and a control circuit electrically coupled to the first gate terminals of the plurality of first transistors and configured to determine a number of said plurality of the first transistors to be turned on according to a difference between a voltage at the output terminal and a first predetermined reference voltage;

wherein the control circuit comprises:

a first phase delay unit, comprising:

a first delay chain comprising a plurality of first internal circuits coupled in series and configured to receive a clock signal that includes a phase and delay the phase of the received clock signal; and a plurality of first delay control units, each of said plurality of the first delay control units being configured to control a time delay degree of a signal received by a corresponding first internal circuit according to the value of the voltage at the output terminal of the voltage regulator circuit; a second phase delay unit, comprising:

a second delay chain comprising a plurality of second internal circuits coupled in series and configured to receive the clock signal and delay the phase of the clock signal received by the second delay chain; and a plurality of second delay control units, each of said plurality of the second delay control unit being configured to control a time delay degree of a signal received by a corresponding second internal circuit according to the value of the first predetermined reference voltage; and a plurality of phase comparison units, each of said plurality of the phase comparison units being electrically coupled to an output of a corresponding stage of the first internal circuits in the first delay chain and an output of a corresponding stage of said plurality of the second internal circuits in the second delay chain and configured to compare phases of two output signals respectively generated by the corresponding stages of the first and second internal circuits in the first and second delay chains, so as to generate a comparison result and turn on or turn off a corresponding first transistor based on the comparison result.

9. The voltage regulating circuit according to claim 8, wherein each of said plurality of the first internal circuits and the second internal circuits comprises an inverter, each of said plurality of the first delay control units and the second delay control units comprises a transistor, each transistor in said plurality of the first delay control units is configured to have its gate terminal receiving the voltage at the output terminal of the voltage regulator circuit, each transistor in said plurality of the second delay control units is configured to have its gate terminal receiving the first predetermined reference voltage, each inverter is electrically coupled to ground via one corresponding transistor either in the first delay control unit or in the second delay control unit.

10. The voltage regulating circuit according to claim 8, wherein each of said plurality of the phase comparison unit comprises a D-type flip-flop having a signal input terminal, a clock input terminal and a signal output terminal, the signal and clock input terminals are configured to receive the output signals of two corresponding stages of the first and second internal circuits in the first and second delay chains, respectively, and the signal output terminal is configured to output one of the comparison results.

11. The voltage regulating circuit according to claim 8, wherein said plurality of the first transistors have the same element size.

12. The voltage regulating circuit according to claim 8, wherein said plurality of the first transistors have different element sizes.

13. The voltage regulating circuit according to claim 8, further comprising:

a plurality of second transistors, each of said plurality of the second transistors having a third source/drain, a fourth source/drain terminal and a second gate terminal, the third source/drain terminal being electrically coupled to the output terminal of the voltage regulator circuit, the fourth source/drain terminal being electrically coupled to a reference voltage, wherein the control circuit is further electrically coupled to the second gate terminals and configured to determine a number of said plurality of the second transistors to be turned on according to the difference between the voltage at the output terminal and the first predetermined reference voltage.

14. The voltage regulating circuit according to claim 13, wherein the first and second transistors have the same element size.

15. The voltage regulating circuit according to claim 13, wherein the first transistors and the second transistors have different element sizes.

16. The voltage regulating circuit according to claim 13, wherein the control circuit comprises:

a third phase delay unit, comprising:

a third delay chain comprising a plurality of third internal circuits coupled in series and configured to receive an inversion signal of the clock signal and delay the phase of the received inversion signal of the clock signal;

and a plurality of third delay control units, each of said plurality of the third delay control units being configured to control a time delay degree of a signal received by a corresponding third internal circuit according to a value of the first predetermined reference voltage; a fourth phase delay unit, comprising:

a fourth delay chain comprising a plurality of fourth internal circuits coupled in series and configured to receive the inversion signal of the clock signal and delay the phase of the received inversion signal of the clock signal; and a plurality of fourth delay control units, each of said plurality of the fourth delay control units being configured to control a time delay degree of a signal received by a corresponding fourth internal circuit according to a value of the voltage at the output terminal of the voltage regulating circuit; and a plurality of second phase comparison units, each second phase comparison unit being electrically coupled to an output of a corresponding stage of the third internal circuits in the third delay chain and an output of a corresponding stage of the fourth internal circuits in the fourth delay chain and configured to compare phases of two output signals respectively generated by the corresponding stages of the third and fourth internal circuits in the third and fourth delay chains, so as to generate a second comparison result and turn on or turn off a corresponding second transistor based on the second comparison result.

17. The voltage regulating circuit according to claim 16, wherein each of the first, second, third and fourth internal circuits comprises an inverter, each of said plurality of the first, second, third and fourth delay control units comprises a transistor, each transistor in the first and fourth delay control units is configured to have its gate terminal receiving the voltage at the output terminal of the voltage regulating circuit, each transistor in said plurality of the second and third delay control units is configured to have its gate terminal receiving the first predetermined reference voltage, each inverter is electrically coupled to the reference voltage via one corresponding transistor in one of the first, second, third and fourth delay control units.

18. The voltage regulating circuit according to claim 16, wherein each of said plurality of the first and the second phase comparison units comprises a D-type flip-flop having a signal input terminal, a clock input terminal and a signal output terminal, the signal and clock input terminals are configured to receive output signals of two corresponding stages of the internal circuits in the first and second delay chains respectively or receive output signals of two corresponding stages of the internal circuits in the third and fourth delay chains respectively, and the signal output terminal is configured to output one of the first comparison results or one of the second comparison results.

* * * * *